US006540018B1

(12) United States Patent
Vinegar et al.

(10) Patent No.: US 6,540,018 B1
(45) Date of Patent: Apr. 1, 2003

(54) METHOD AND APPARATUS FOR HEATING A WELLBORE

(75) Inventors: Harold J. Vinegar, Houston, TX (US); Scott Lee Wellington, Houston, TX (US)

(73) Assignee: Shell Oil Company, Houston, TX (US)

( * ) Notice: Subject to any disclaimer, the term of this patent is extended or adjusted under 35 U.S.C. 154(b) by 169 days.

(21) Appl. No.: 09/264,437

(22) Filed: Mar. 8, 1999

Related U.S. Application Data

(60) Provisional application No. 60/077,160, filed on Mar. 6, 1998.

(51) Int. Cl.[7] ..... E21B 36/04; E21B 43/02

(52) U.S. Cl. ..... 166/60; 166/302

(58) Field of Search ..... 219/415, 417, 219/418; 166/288, 302, 57, 60, 61, 249; 392/305, 306; 299/14

(56) References Cited

U.S. PATENT DOCUMENTS

| | | | | | |
|---|---|---|---|---|---|
| 2,732,195 | A | | 1/1956 | Ljungstrom | 166/302 |
| 2,754,912 | A | * | 7/1956 | Curson | 166/60 |
| 2,932,352 | A | * | 4/1960 | Stegemeier | 166/60 |
| 4,185,691 | A | * | 1/1980 | Tubin et al. | 166/302 |
| 4,199,025 | A | * | 4/1980 | Carpenter | 166/248 |
| 4,640,352 | A | | 2/1987 | Vanmeurs et al. | 166/245 |
| 4,886,118 | A | | 12/1989 | van Meurs et al. | 166/245 |
| 5,065,818 | A | | 11/1991 | Van Egmond | 166/60 |
| 5,070,533 | A | * | 12/1991 | Bridges et al. | 392/301 |
| 5,244,310 | A | | 9/1993 | Johnson | 405/128 |
| 5,318,116 | A | | 6/1994 | Vinegar et al. | 166/60 |

* cited by examiner

*Primary Examiner*—David Bagnell
*Assistant Examiner*—Jennifer R. Dougherty
(74) *Attorney, Agent, or Firm*—Del S. Christensen

(57) ABSTRACT

An electrical heater is provided, the electrical heater being useful for heating soil around a wellbore, and the heater including: a plurality of electrically conductive heater elements within a wellbore, each element spaced from the other elements and located around the circumference of a wellbore; and an electrically insulating filer surrounding the elements within the wellbore; wherein a metal casing around the heater is not present.

7 Claims, 2 Drawing Sheets

METHOD AND APPARATUS FOR HEATING A WELLBORE

This application claims the benefit of U.S. Provisionl Application No. 60/077,160 filed on Mar. 6, 1998, the entire disclosure of which is hereby incorporated by reference.

FIELD OF THE INVENTION

This invention relates to a electrical heating method and apparatus useful in a borehole.

BACKGROUND TO THE INVENTION

U.S. Pat. Nos. 4,640,352 and 4,886,118 disclose conductive heating of subterranean formations of low permeability that contain oil to recover oil therefrom. Low permeability formations include diatomites, lipid coals, and oil shales. Formations of low permeability are not amiable to secondary oil recovery methods such as steam, carbon dioxide, or fire flooding. Flooding materials tend to penetrate formations that have low permeabilities preferentially through fractures. The injected materials bypass most of the formation hydrocarbons. In contrast, conductive heating does not require fluid transport into the formation. Oil within the formation is therefore not bypassed as in a flooding process. Heat injection wells are utilized to provide the heat for such processes.

Heat injection wells can also be useful in decontamination of soils. U.S. Pat. Nos. 5,318,116 and 5,244,310, for example, disclose methods for decontamination of soils wherein heat is injected below the surface of the soil in order to vaporize the contaminates. The heaters of patent '310 utilize electrical resistance of spikes, with electricity passing through the spikes to the earth. Patent '116 discloses heater elements passing through the wellbore to the bottom of the formation to be heated. The wellbore surrounding the heater includes a catalyst bed, which is heated by the heater elements. Heat conductively passes through the catalyst bed to a casing surrounding the catalyst bed, and then radiantly from the casing to the soil surrounding the wellbore. Typical alumina based catalysts have very low thermal conductivities, and a significant temperature gradient will exist through the catalyst bed. This significant temperature gradient will result in decreased heat transfer to the earth being heated at a limited heater element temperature.

U.S. Pat. No. 5,065,818 discloses a heater well with sheathed and mineral insulated ("MI") heater cables cemented directly into the wellbore. The MI cables includes a heating element surrounded by, for example, magnesium oxide insulation and a relatively thin sheathing around the insulation. The outside diameter of the heater cable is typically less than one half of an inch (1.25 cm). The heater well optionally includes a channel for lowering a thermocouple through the cemented wellbore for logging a temperature profile of the heater well. Being cemented directly into the wellbore, a need for a casing (other than the sheathing of the cable) is eliminated, but the outside diameter of the cable is relatively small. The small diameter of the heater cable limits the amount of heat that can be transferred to the formation from the heater cable because the area through which heat must pass at the surface of the cable is limited. A cement will have a relatively low thermal conductivity, and therefore, a greater heat flux at the surface of the cable would result in an unacceptably high heater cable temperature. Multiple heater cables may be cemented into the wellbore to increase the heat transfer to the formation above that which would be possible with only one cable, but it would be desirable to further increase the heat that can be transferred into earth surrounding the heaters.

U.S. Pat. No. 2,732,195 discloses an electrical heater well wherein an "electrically resistant pulverulent" substance, preferably quartz sand or crushed quartz gravel, is placed both inside and outside of a casing of a wellbore heater, and around an electrical heating element inside of the casing. The quartz is placed there to reinforce the casing against external pressures, and a casing that is sealed against the formation is required. The casing adds considerable expense to the installation.

It is therefore an object of the present invention to provide a wellbore heater wherein the heater has a greater surface area at the temperature of the electrical resistance element than those of the prior art, and in which a substantial casing is not required. This heater is useful as a well heater for such purposes as thermal recovery of hydrocarbons and soil remediation.

SUMMARY OF THE INVENTION

These and other objects are accomplished by an electrical heater comprising: a plurality of electrically conductive heater elements within a wellbore, each element spaced from the other elements and located around the circumference of a wellbore; and an electrically insulating filler surrounding the elements and filling the wellbore; wherein a metal casing around the heater elements is not present. Elimination of the casing significantly reduces the cost of a heat injection well. This reduction in cost is significant in an application such as heat injectors for recovery of hydrocarbons from, for example, oil shales, tar sands, or diatomites. Heat injection can also be used to remove many contaminates from contaminated soils.

DETAILED DESCRIPTION OF THE INVENTION

Figure 1:
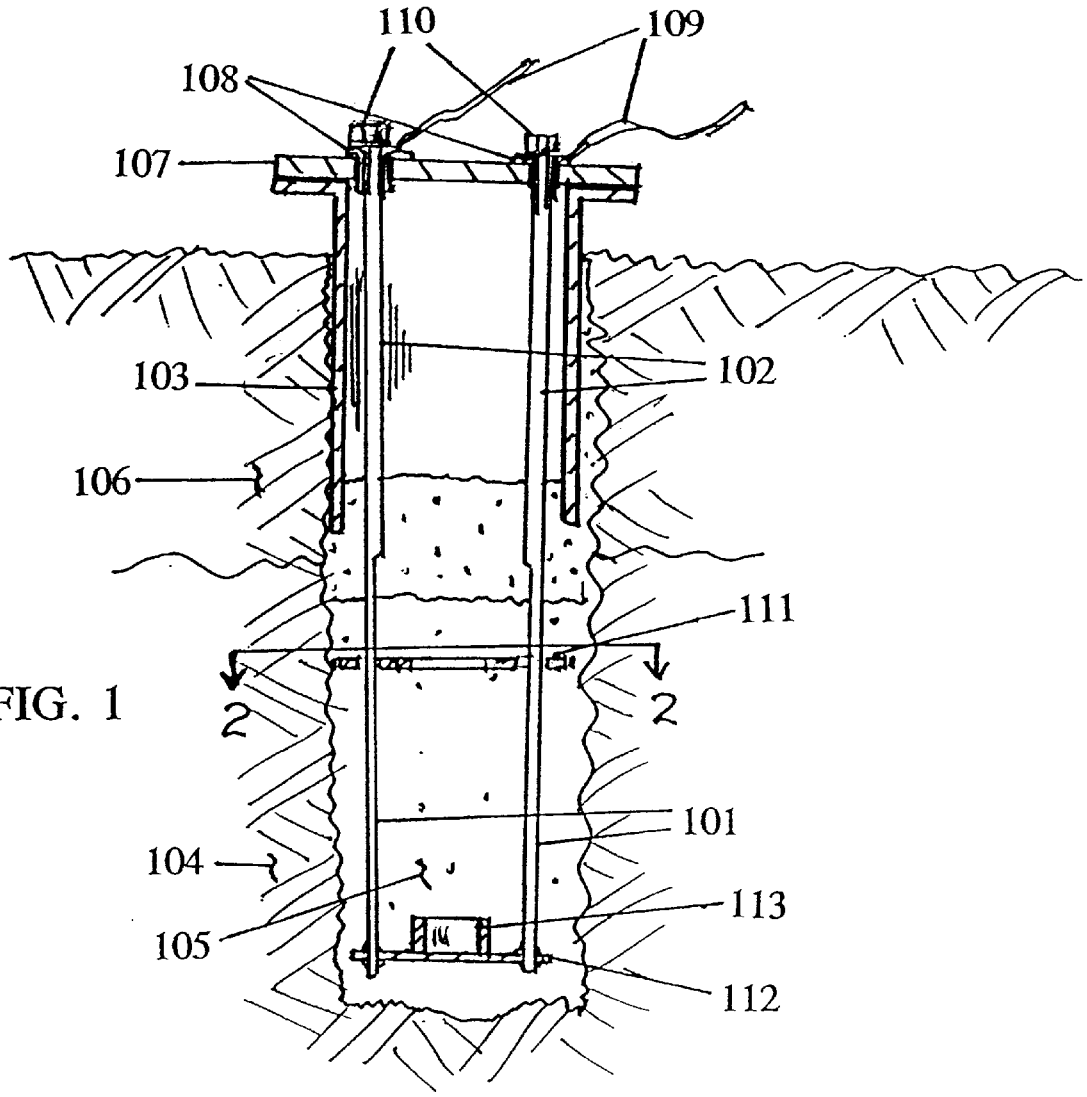
FIG. 1 shows a heater according to the present invention within a wellbore.

The heater of the present invention has electrically conductive heating element which are spaced from each other around the circumference of a wellbore. Providing the elements close to the wall of a wellbore maximizes the heat that can be transferred into the soil surrounding the wellbore without exceeding maximum heater element temperatures. An electrically insulating filler is placed around and inside of the heating elements to essentially eliminate electrical shorting of the elements to the formation. This electrically insulating material could be a material that is initially wet, and therefore electrically conducting until it is dried. The drying step could be accomplished by passing electricity through the heating element and into the wet material, and heat generated by the electrical energy would gradually heat the soil and eventually vaporize liquid water initially present. When water is initially present in the electrical insulating material, and electrical current from the heater element is used to dry the material, the power will initially be high current and low voltage until removal of liquid water increases the resistivity of the material. As the resistivity increases, the voltage will rise for a fixed amount of current.

The voltage measured with a limited current will therefore be a good indicator of the progress of drying. The remaining dry material is an acceptable electrical insulator. Sand is an acceptable filler. A hydraulic cement could also be used. Hydration of the cement reduces free liquid water, and the cured cement can be an acceptable electrical insulator. Other materials could be used as the insulating material. Preferably materials are easily placed and inexpensive. An ideal material would also either be or readily become an electrically nonconducting material. A material such as sand could be placed pneumatically or as a slurry.

A plurality of electrical heating elements are placed in the wellbore to form the heater, with the elements connected at the lower portion of the wellbore, and different phases of alternating electrical power applied the elements. At least six elements are preferred in order to provide heat around the entire circumference of the wellbore.

The heating elements can be, for example, stainless steel wire, nickel-chrome alloy wire or carbon fiber elements. The wires are preferably between about 0.2 and about 0.8 mm in diameter and more preferably about 0.3 mm in diameter. Thicker elements provided greater allowances for corrosion, but at the expense of greater current requirements and greater material costs. Thickness of the element is chosen to result in a voltage requirement at the targeted heat flux which is not excessively low or high. For example, a voltage differential of about 60 to about 960 volts AC between the upper ends of two elements within a wellbore which have connected lower ends would be preferred. For shorter heaters (2 to 200 meters), voltages of 60 to 480 volts AC are preferred, and for longer heaters (100 to 700 meters) a voltage of 480 to 960 volts AC is preferred. To accommodate greater thicknesses of elements, multiple heaters could be provided in series, but the extent to which this can be done is limited by the expense of the cables leading to the heater elements.

Generally, heater elements of stainless steel of, for example, grades 304, 316, or 310 are preferred. Stainless steels are not excessively expensive, and would withstand exposure to elements that may be present during start-up phases for long enough to get the elements up to elevated temperatures, and sufficiently low corrosion rates when exposed to most borehole environments for extend periods of time at elevated temperatures. Carbon steels could be used as heater elements for applications where heat does not have to be provided for extended periods of time. For shallow applications such as soil remediation, nichrome 80 is preferred.

Thermocouples for control of the heaters could be provided within the wellbore, either inside of the ring of heater elements, outside of the elements, or attached to the heater elements. The thermocouples could be, for example, secured to one of the electrically insulating spacers. The thermocouple could be used to monitor the operation, or to control electrical power applied to the heater element. When thermocouples are used to control the electrical power, multiple thermocouples could be provided and the control temperature selected from the thermocouples. The selection could be based on a maximum temperature, an average temperature, or a combination such as an average of the highest two or three temperatures.

The heater elements of the present invention can be made to a wide variety of lengths because of the flexibility to select different combinations of voltages and diameters of the heater elements. Heaters as short as two meters can be used, and as long as 700 meters could be provided.

A borehole within which the heater of the present invention is placed may be cased and cemented for at least a portion of the borehole above the heater, to ensure isolation of the formation to be heated. In a shallow well, the borehole may be filled with sand or a bentonite slurry to the surface. The bentonite slurry prevents water ingress from above.

Referring now to FIG. 1, a schematic of the heater of the present invention is shown. Heater elements 101 (two shown) are provided with electrical leads to the elements 102 which are larger in diameter than the heater elements, but can be of the same material. The number of elements is preferably between two and six. The electrical leads are shown extending to individual heater elements, but a spacer could be provided wherein only one electrical lead is provided for each phase of electrical energy, and the power is applied in parallel or series to different heater elements. The borehole within which the heater is placed is preferably between about 5 and about 20 centimeters in diameter, and the heater element are preferably placed between about one half and about one centimeter from the wall of the borehole. The elements are preferably separated by between about four and about eighteen centimeters. Fewer elements generally reduces the cost of the heater, but a larger number of elements permits greater heat flux into a formation from the heater at limited heater element temperature. The heater elements are not individually electrically insulated, but rely on the electrical insulating properties of electrically insulating filler material surrounding the elements. A casing 103 is provided at the surface for isolation, but preferably does not extend to the soil to be heated 104, but only through an overburden 106. Sand or a hydraulic or ceramic cement 105 is shown surrounding the heater elements. When the soil is to be heated to the surface, a short tube could be provided to provide a stable flange for securing the tops of the heater elements.

A flange 107 is shown with insulating sleeves 108 around the electrical leads to the heater elements. Power supply wires 109 provide electrical power to the electrical leads, and are secured by nuts 110.

An electrical insulating spacer 111 provides separation of the electrical elements within the borehole. One electrical insulating spacer is shown, but more than one can be provided, and preferably, one is provided each three to ten meters within the wellbore. Further, the electrical insulating spacer is shown within the heater section, but one or more can also be provided in the electrical lead-in section about the heaters. The electrical insulating spacers can be made from an inexpensive plastic, and do not necessarily have to withstand the elevated operating temperatures. The spacers only need to hold the heater elements in place while the filler material is placed around the elements. Alternatively the spacers could be made from ceramics such as alumina, or machineable ceramics such a MACOR.

The lower ends of the heater elements can be connected with an electrically conducting connector 112. The electrically conducting connector can connect all of the elements, or a combination of elements such that each of the elements has electrical continuity necessary for current to pass through the elements. The electrically conducting connector optionally has a cup 113 for securing the connector to a tube for lowering the elements, connector and spacer down the borehole. A tubing from, for example, a coiled tubing unit, could be placed within the cup 113, and the cup held to the coiled tubing either by, for example, a friction fit which could be broken by pressure from with the coiled tubing, or the tubing could be held to the cup by tension from the heater elements as the connector is lowered into the borehole.

The electrically conducting connector is shown at the bottom of the wellbore, with each heater element extending uniformly down the heated portion of the wellbore. But the number and/or heat duties of the heater elements can vary along the length of the heater. The diameters of the heating elements can vary along the length of the heater to tailor the heat deposition to a desired profile.

Figure 2:
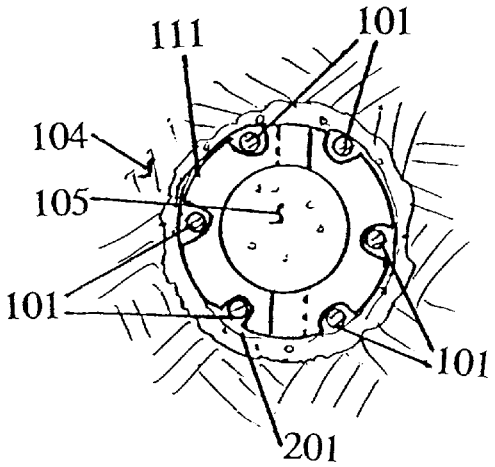
FIG. 2 shows a cross sectional view of the heater in a borehole.

Referring now to FIG. 2, a view looking down at the electrically insulating spacer is shown. Heater elements 101 (six shown) are separated by insulating spacer 111, with the electrically insulating filler such as sand or cement 105 surrounding the spacer and heater elements. The soil to be heated 104 surrounds the heater. The electrically insulating spacer 111 is shown as being in two parts, with mating tongues and groves to allow the spacers to be slipped inside the heater elements and around a tube when the tube is being used to lower the heater elements into the borehole. A tie wrap 201 can be used to secure the heater elements in notches within the spacer. The spacer may be secured vertically to the heater elements by friction, or may be held vertically by clamps (not shown) placed above, or above and below the spacer on one or more of the heater elements.

Figure 3:
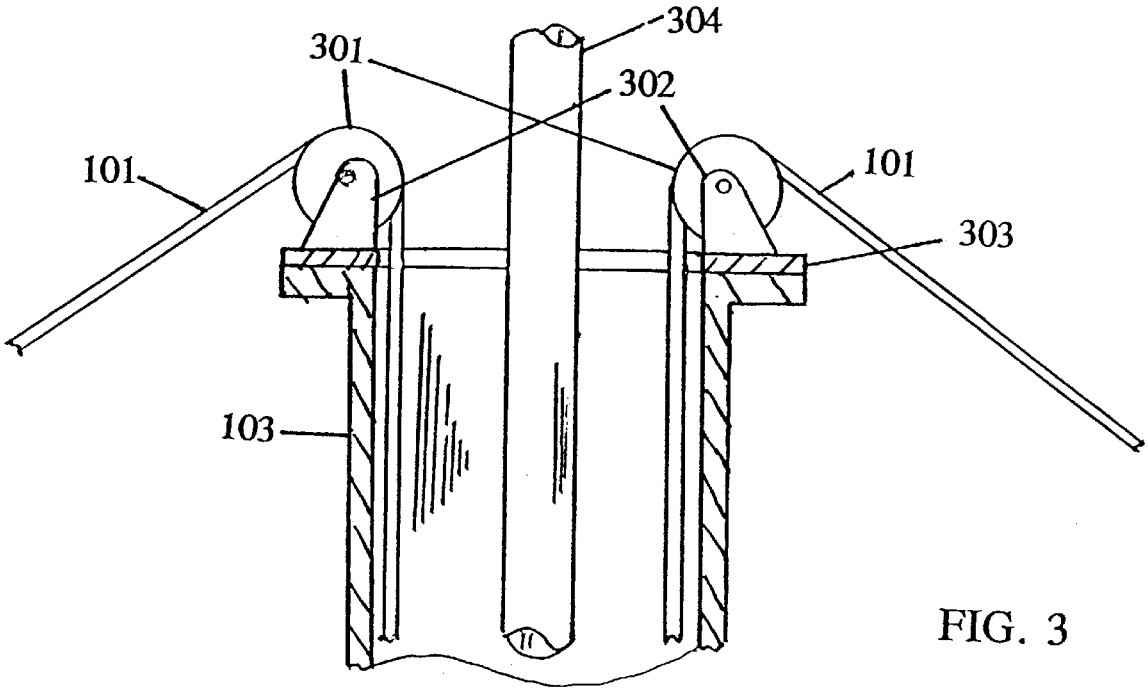
FIG. 3 shows an apparatus for installing the heater of the present invention.

Referring now to FIG. 3, an apparatus which can be used to place the heater of the present system into a welibore is shown. Heater elements 101 (two shown) are strung over pullies 301, the pullies mounted on brackets 302 which are set on a flange 303. The flange 303 is mounted on the casing 103, which is equipped with a mating flange. The heater elements 101 are rolling off spools (not shown) and can be maintained in slight tension to prevent entanglement of the heater elements within the borehole. A coiled tubing 304 is shown extending into the borehole. The coiled tubing can be used to place the heater elements and electrical leads within the borehole, and then used to fill the borehole with the electrically insulating filler as it is removed.

The heating elements can be of a wide variety of lengths and a wide variety of distances down a borehole. For example, for heating an oil shale formation, the heater may be 400 meters long. For remediation of contaminated soil, the heater may be only two or three meters long, although longer heater elements are more advantageously provided by the present invention. The heaters may be provided an extended distance down the borehole. For example, an oil shale formation may be heated which lies under 400 meters of overburden. As the length of the heater and electrical leads become very long, the heater elements and/or electrical leads may be required to be of larger diameter or may need to be made of a material which has greater strength because these elements must be self supporting until the electrically insulating filler is placed around the elements. The heater elements therefore do not have to be self supporting at operating temperatures because friction with the electrically insulating filler will provide vertical support for the elements.

We claim:

1. A wellbore heater comprising:

a plurality of electrically conductive heater elements within the wellbore, each element spaced from the other elements and located around the circumference of the wellbore; and an electrically insulating filler surrounding the elements within the wellbore;

wherein a metal casing around the heater is not present and the heater elements are not individually electrically insulated.

2. The heater of claim 1 further comprising at least one electrically insulating spacer maintaining a separation between the elements and between the elements and the sides of the wellbore.

3. The heater of claim 1 further comprising an electrically conductive connector at the lower extremity of the heater elements, the electrically conductive connector providing electrical continuity between each heater element and at least one other heater element.

4. The heater of claim 3 wherein the electrically conductive connector includes a means for attaching the electrically conductive connector to the end of a tube.

5. The heater of claim 1 wherein the electrically insulating filer is sand.

6. The heater of claim 1 wherein the electrically insulating filler is a hydraulic refractory cement.

7. The heater of claim 1 further comprising electrical leads extending from the surface to each of the heater elements.

* * * * *